US007594549B2

(12) United States Patent
Hua

(10) Patent No.: US 7,594,549 B2
(45) Date of Patent: Sep. 29, 2009

(54) ROTATING DIRECTION SWITCHING DEVICE FOR A PNEUMATIC TOOL

(75) Inventor: Chris Hua, Taichung (TW)

(73) Assignee: Basso Industry Corp., Taichung (TW)

( * ) Notice: Subject to any disclaimer, the term of this patent is extended or adjusted under 35 U.S.C. 154(b) by 0 days.

(21) Appl. No.: 11/735,486

(22) Filed: Apr. 15, 2007

(65) Prior Publication Data

US 2008/0251269 A1 Oct. 16, 2008

(51) Int. Cl.
*B27C 3/08* (2006.01)

(52) U.S. Cl. ..... 173/104; 173/109; 173/168; 173/169; 173/170; 173/171; 90/418

(58) Field of Classification Search ..... 173/104, 173/109, 168–171; 91/418
See application file for complete search history.

(56) References Cited

U.S. PATENT DOCUMENTS 3,129,796 A * 4/1964 Karden ..... 173/93.5
5,303,781 A * 4/1994 Lin ..... 173/169
5,377,769 A * 1/1995 Hasuo et al. ..... 173/169
6,062,323 A * 5/2000 Pusateri et al. ..... 173/169
6,634,438 B1 * 10/2003 Pusateri et al. ..... 173/1
6,883,619 B1 * 4/2005 Huang ..... 173/93.5
7,213,500 B2 * 5/2007 Chang ..... 91/418
7,311,155 B2 * 12/2007 Chang ..... 173/104
2002/0084086 A1 * 7/2002 Taga ..... 173/104
2003/0075348 A1 * 4/2003 Eardley et al. ..... 173/169
2004/0144553 A1 * 7/2004 Ashbaugh ..... 173/169
2007/0289760 A1 * 12/2007 Sterling et al. ..... 173/104

* cited by examiner

*Primary Examiner*—Rinaldi I. Rada
*Assistant Examiner*—Michelle Lopez
(74) *Attorney, Agent, or Firm*—CKC & parters Co., Ltd.

(57) ABSTRACT

A rotating direction switching device for a pneumatic tool comprises an air inlet valve and a switch. The air inlet valve is driven to switch the rotating direction of the pneumatic tool by controlling the switch, thus simplifying the operation of switching between the clockwise mode and counterclockwise mode, and facilitating the operation by a single hand. Especially, no matter users who are right hand or left hand dominated could easily operate the pneumatic tool.

6 Claims, 12 Drawing Sheets

ROTATING DIRECTION SWITCHING DEVICE FOR A PNEUMATIC TOOL

BACKGROUND OF THE INVENTION

1. Field of the Invention

The present invention relates to a pneumatic tool, and more particularly to a pneumatic tool having a rotating direction switching device.

2. Description of the Prior Art

Among all kinds of locking members, screws and nuts are most widely used because of their advantages. Therefore, tools for rotating the screws and nuts also have a large space to develop. These tools should be rotatable so as to rotate screws and nuts. However, a conventional tool usually is only able to rotate in a single direction, so two tools with different rotating direction should be prepared during work, and users have to alternately use the two tools, thus wasting time.

In order to solve the abovementioned problem of the conventional tool and make screwing and unscrewing operation more convenient, a pneumatic wrench 10 having the function of switching rotating direction is developed, as shown in FIG. 1 and FIG. 2. A clockwise rotation air hole 11 and a counterclockwise rotation air hole 12 are defined in the pneumatic wrench 10 respectively. A switch 13 provided with a through hole 14 for cooperating with the clockwise rotation air hole 11 and the counterclockwise rotation air hole 12 is pivotally disposed in the pneumatic wrench 10. By turning the switch 13, the through hole 14 can be selectively connected to the clockwise rotation air hole 11 or the counterclockwise rotation air hole 12 to make the pneumatic wrench rotate in clockwise or counterclockwise directions, achieving the function of switching the rotating direction.

Generally speaking, the pneumatic tool 10 has the function of switching rotation direction, but it is inconvenient to use. The reason is that users have to control the switch 13 of the pneumatic tool 10 with the thumb, while the thumb is not a nimble finger and is not used frequently, so it is quite inconvenient to turn the switch 13 with the thumb. In addition, users have to choose at which side of the pneumatic tool 10 the switch 13 is to be fixed according to their dominant hands, so two switches should be prepared to be fixed at different sides of the pneumatic tool 10 for different users with different dominant hands. Therefore, it is inconvenient.

The present invention has arisen to mitigate and/or obviate the afore-described disadvantages.

SUMMARY OF THE INVENTION

The primary objective of the present invention is to provide a rotating direction switching device that utilizes a switch to drive an air inlet valve, and simplifies the operation of switching rotating direction, and is more comfortable and convenient for a single hand to operate.

The secondary objective of the present invention is to provide a rotating direction switching device that is designed for different dominant hands of users, so that they can operate the rotating direction switching device easily no matter they are left hand or right hand dominated.

The rotating direction switching device for the pneumatic tool in accordance with the present invention comprises an air inlet valve and a switch. The air inlet valve is pivotally and rotatably disposed in the pneumatic tool, and a passive portion is defined on a side of the air inlet valve. The switch is fixed in the pneumatic tool and extends out of two sides of the pneumatic tool respectively. The direction of the two ends of the switch is perpendicular to the rotating axis of the air inlet valve. A driving portion is formed on the switch for engaging with the passive portion of the air inlet valve. The switch utilizes the driving portion to drive a passive portion of the air inlet valve and consequently drive the air inlet valve to rotate, thus switching the rotating direction of the pneumatic tool.

The rotating direction switching device for the pneumatic tool in accordance with the present invention utilizes the driving portion of the switch to drive a passive portion of the air inlet valve and consequently drive the air inlet valve to rotate, thus switching the rotating direction of the pneumatic tool. Since the switch is operated by index and thumb, the present invention is more convenient to operate and is more comfortable. No matter users who are right hand or left hand dominated, the rotating direction of the pneumatic tool can be switched very easily.

The passive portion of the air inlet valve in accordance with the present invention can be an engaging structure, and the driving portion of the switch can be a protruding pole for engaging with the passive portion; the passive portion can as also be a protruding pole, and the driving portion of the switch can be a concave structure for engaging with the passive portion, or the passive portion and the driving portion can be toothed structures for engaging with each other.

In addition, the air inlet valve is provided with two passive portions in the form of protruding poles, and the switch is made up of two subassemblies, which extend out of two sides of the pneumatic tool, respectively. Each of the subassemblies is provided with a driving portion that is an engaging structure for engaging with each of the passive portions.

DETAILED DESCRIPTION OF THE PREFERRED EMBODIMENTS

Figure 1:
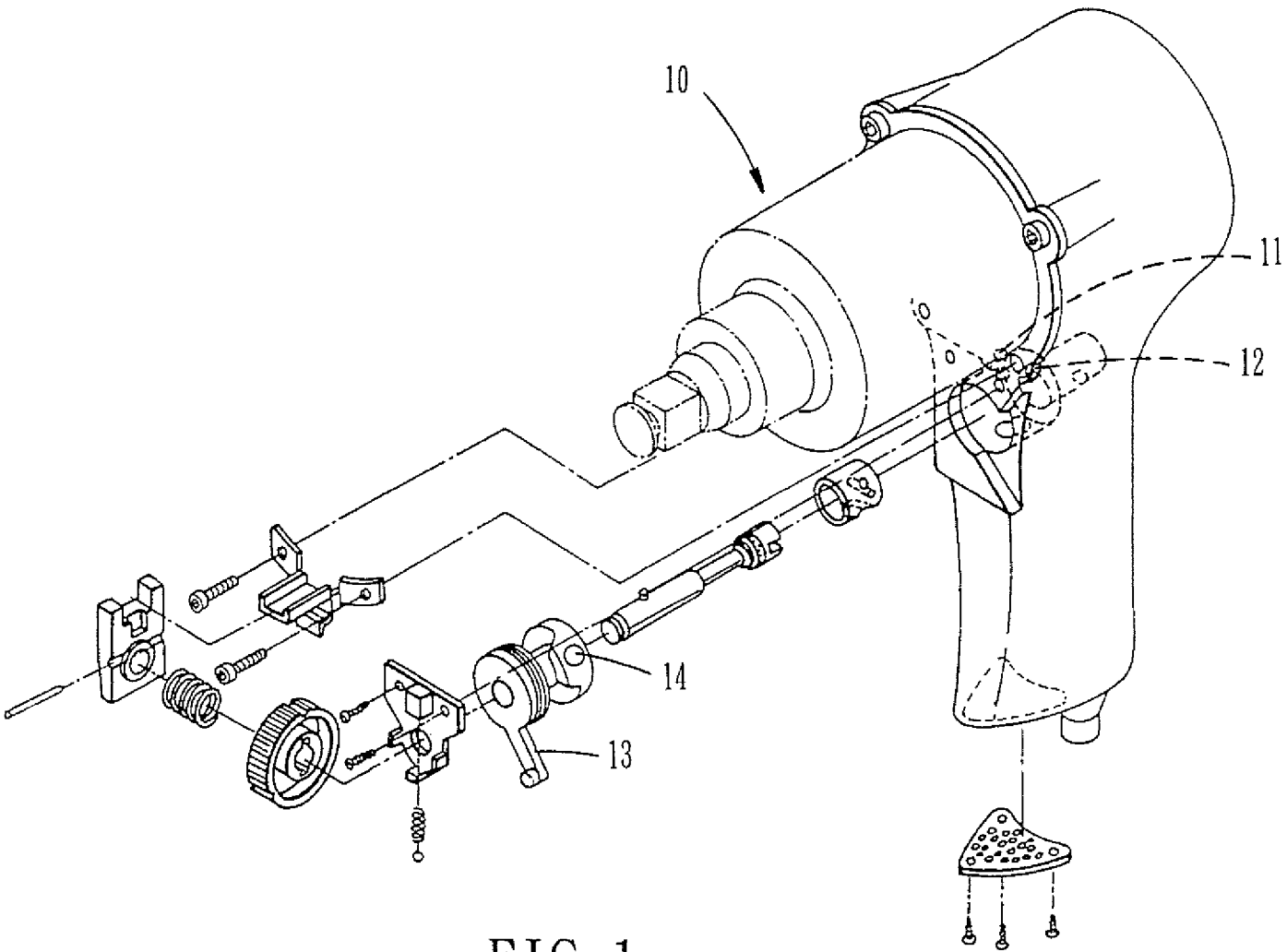
FIG. 1 PRIOR ART
FIG. 1 is an exploded view of a conventional pneumatic tool.
Figure 2:
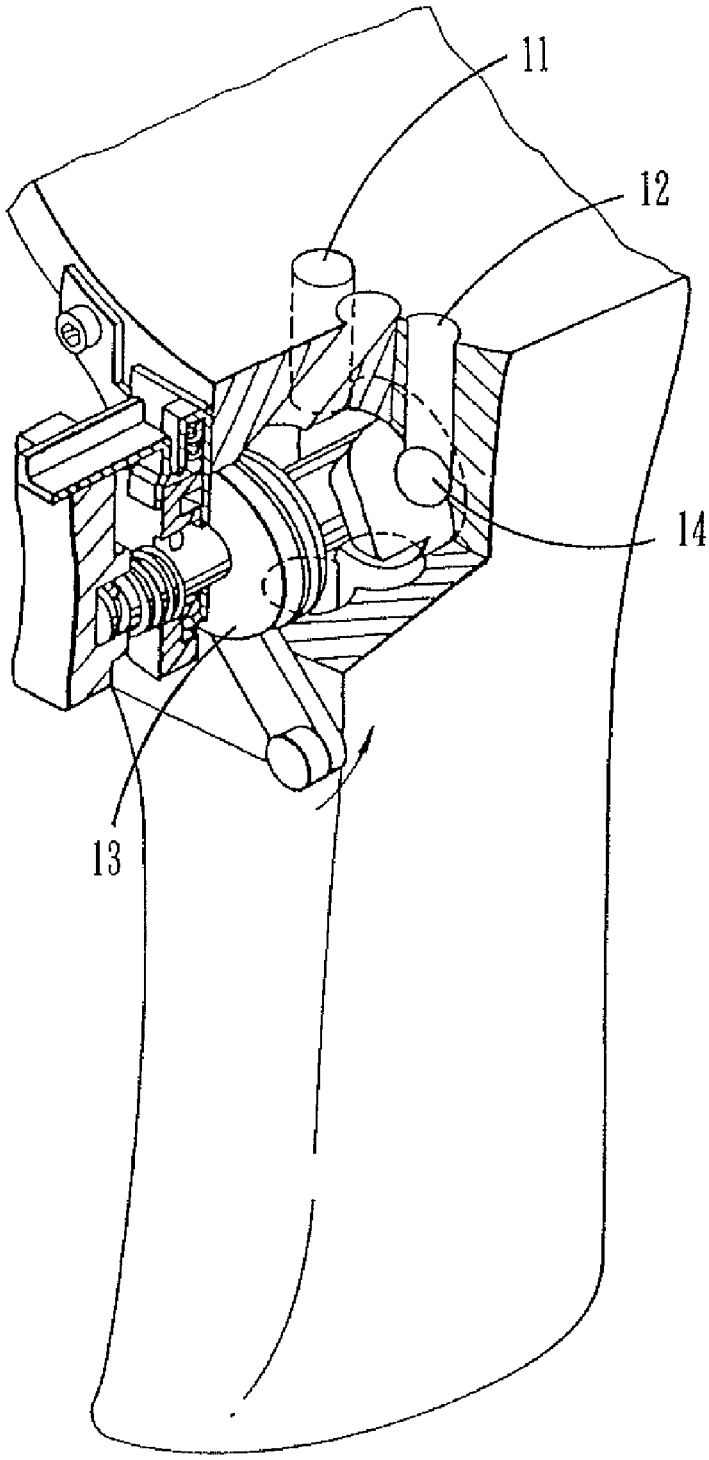
FIG. 2 PRIOR ART
FIG. 2 is a partial cross sectional view of the conventional pneumatic tool.
Figure 3:
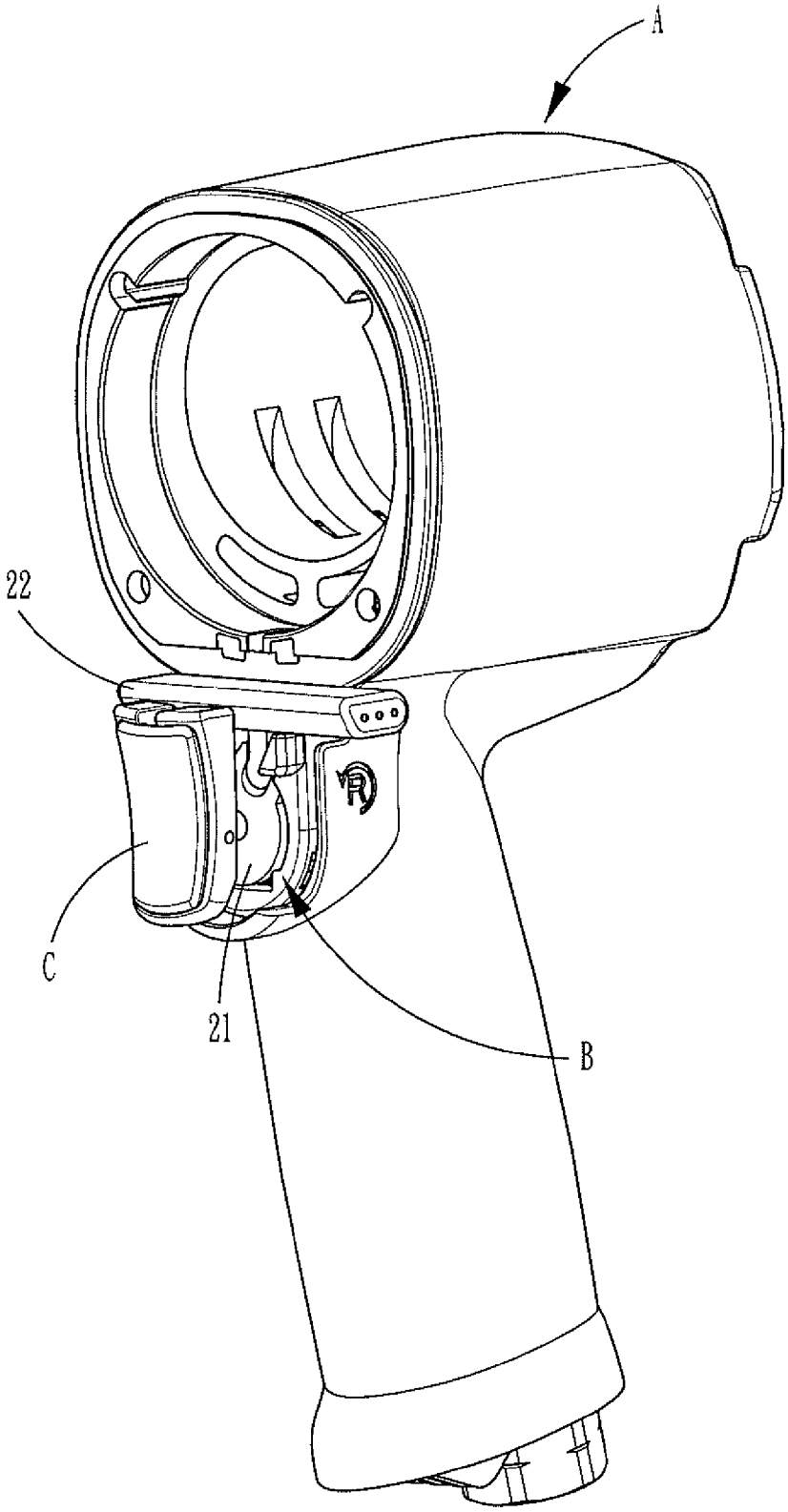
FIG. 3 is a perspective view of showing that the rotating direction switching device in accordance with the embodiment is disposed in the pneumatic tool.
Figure 4:
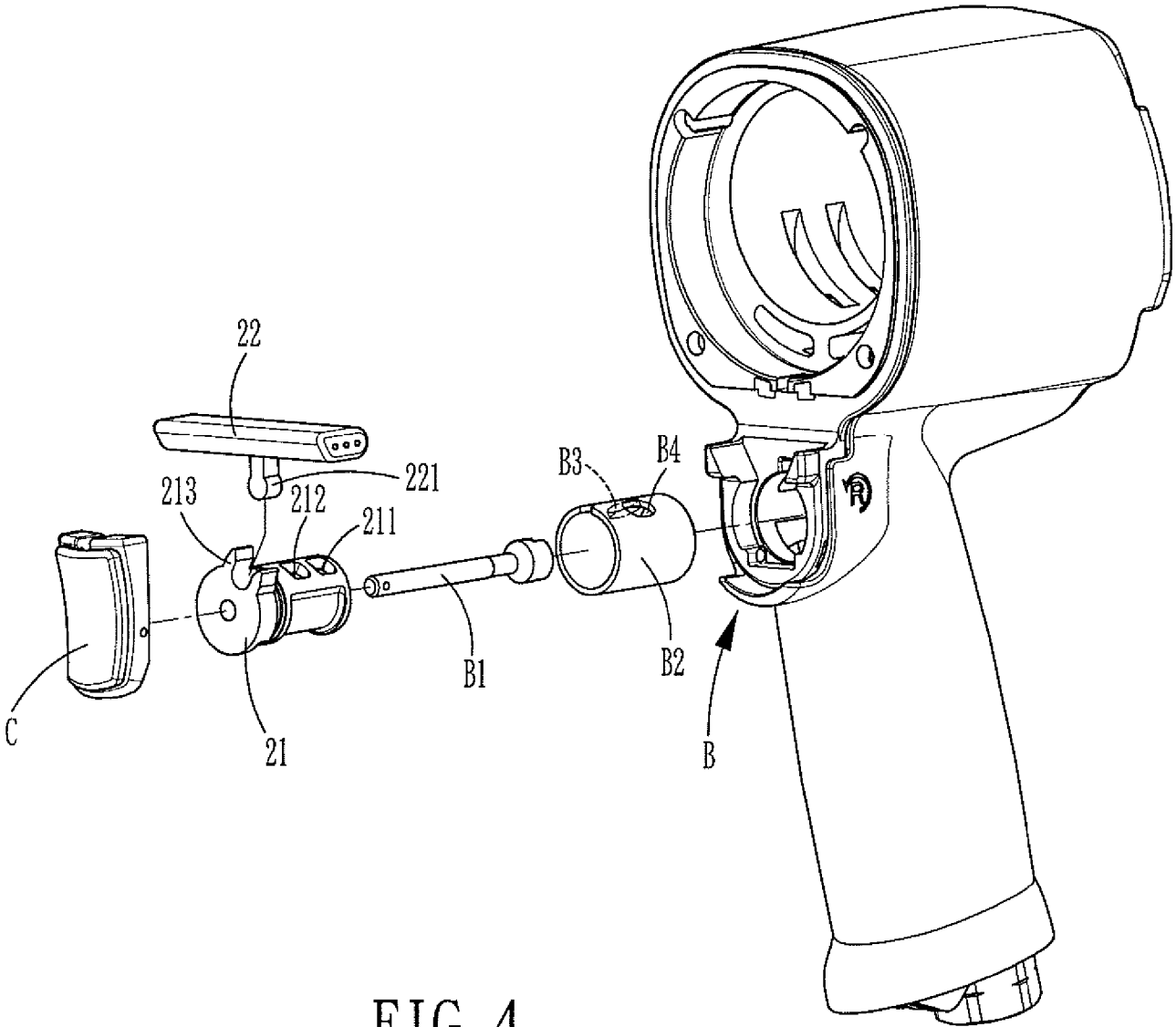
FIG. 4 is an exploded view of showing that the rotating direction switching device in accordance with the embodiment is disposed in the pneumatic tool.
Figure 5:
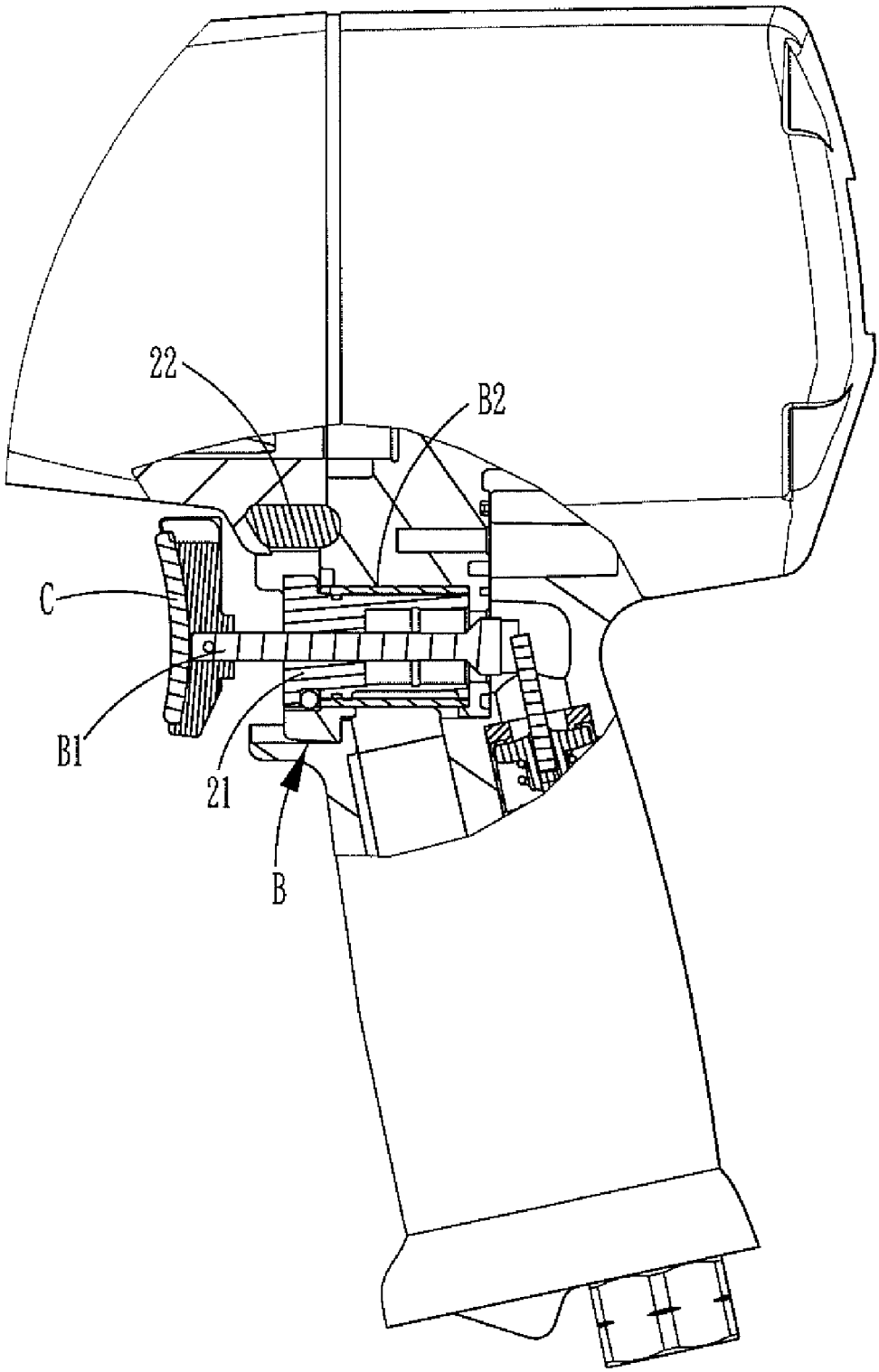
FIG. 5 is a partial cross sectional view of showing that the rotating direction switching device in accordance with the embodiment is fixed in the pneumatic tool.

The present invention will be more clear from the following description when viewed together with the accompanying drawings, which show, for purpose of illustrations only, the preferred embodiment in accordance with the present invention.

Referring to FIGS. 3-8, a rotating direction switching device for a pneumatic tool in accordance with the present invention is disposed between a valve seat B and a trigger C of the pneumatic tool A. The valve seat B is provided with a controlling shaft B1 and a valve sleeve B2, and the valve sleeve B2 is provided with a clockwise rotation air hole B3 and a counterclockwise rotation air hole B4 for cooperating with a clockwise rotation air inlet passage D and a counterclockwise rotation air inlet passage E of the pneumatic tool A, respectively.

An embodiment of the rotating direction switching device comprises an air inlet valve 21 and a switch 22.

The air inlet valve 21 is a hollow tubular structure pivotally and rotatably inserted on the controlling shaft B1 of the valve seat B, and is received in the valve sleeve B2. A clockwise air inlet hole 211 and a counterclockwise inlet hole 212 are defined in the air inlet valve 21 for cooperating with the clockwise rotation air hole B3 and the counterclockwise rotation air hole B4 of the valve sleeve B2, respectively. A passive portion 213 is defined on a side of the air inlet valve 21, which is an engaging structure in this embodiment.

Figure 6:
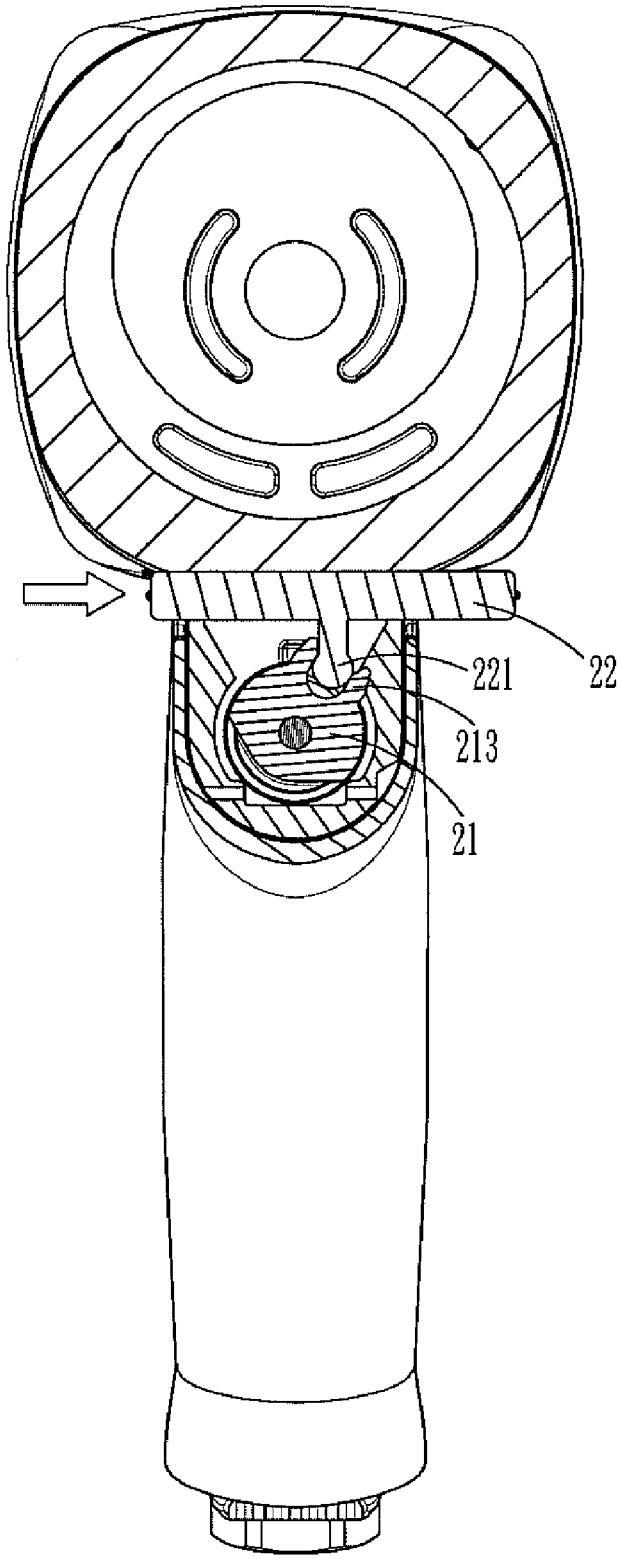
FIG. 6 is a perspective view of showing that the air inlet valve and the switch in accordance with the embodiment is fixed in the pneumatic tool and is pushed to one side.
Figure 7:
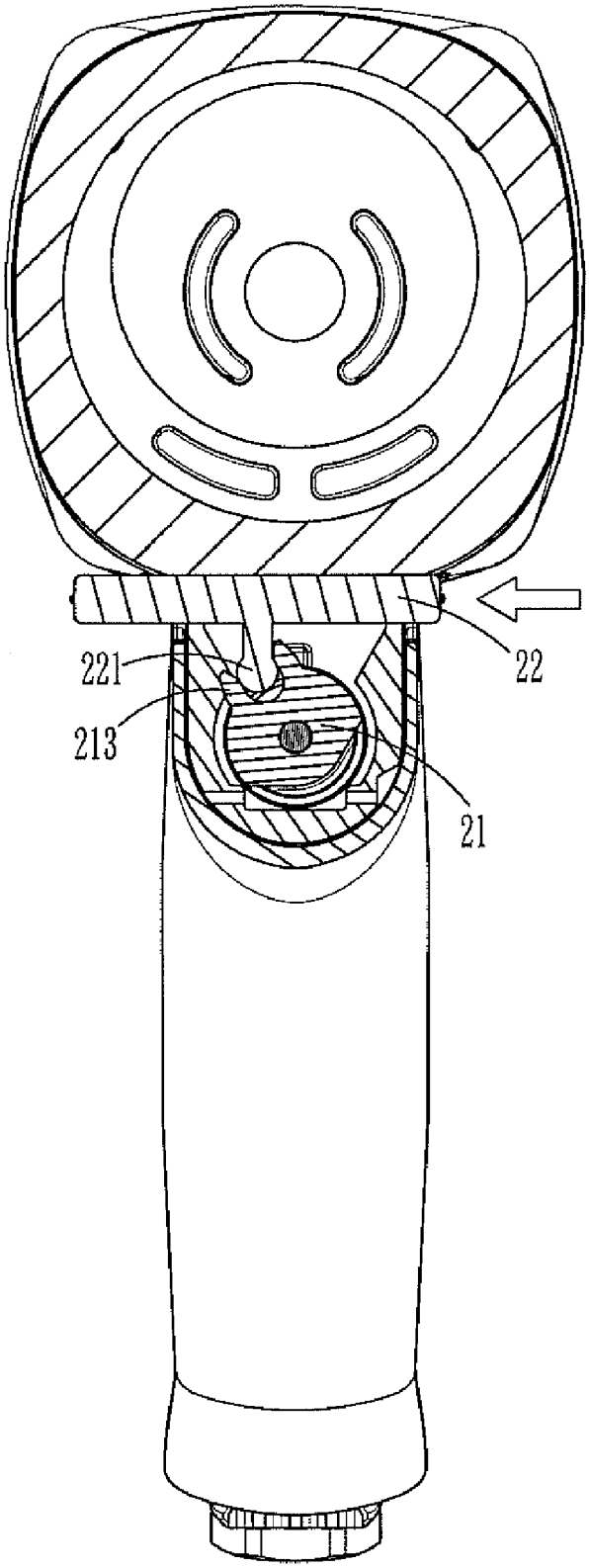
FIG. 7 is a perspective view of showing that the air inlet valve and the switch in accordance with the embodiment is fixed in the pneumatic tool and is pushed to the other side.
Figure 8:
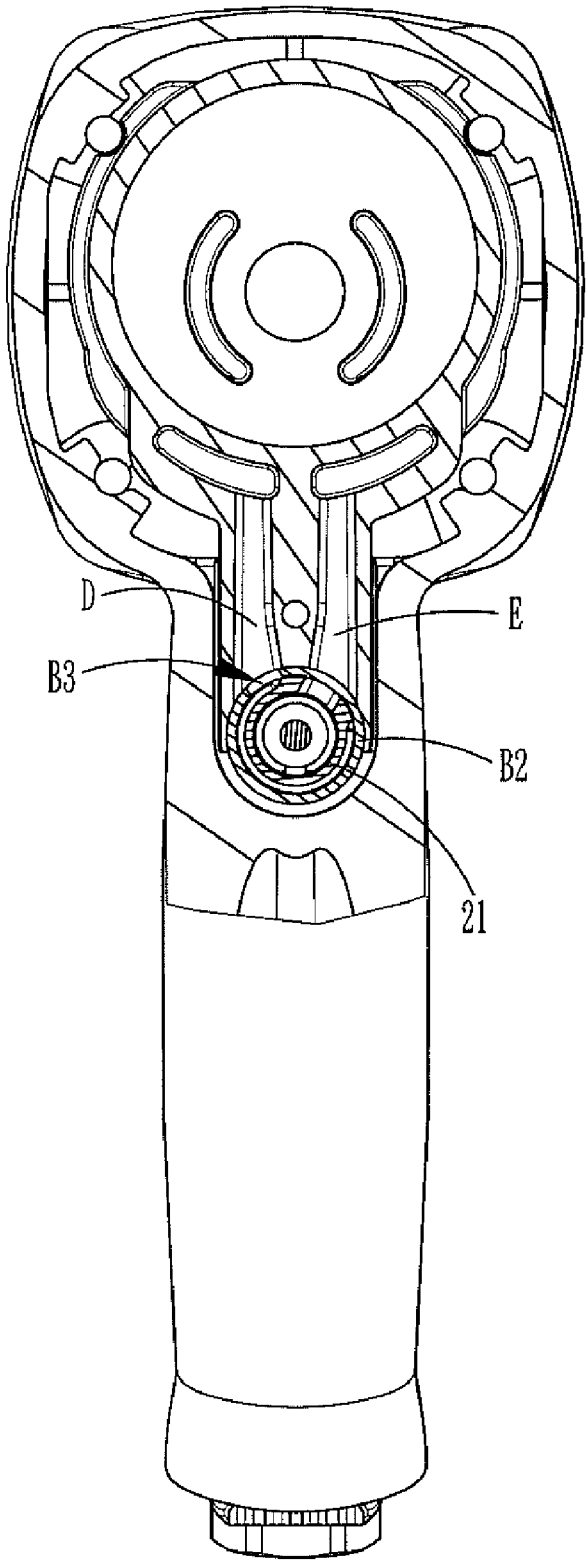
FIG. 8 is a cross sectional view of showing that the air inlet valve in accordance with the embodiment is received in the valve sleeve.

The switch 22 is fixed in the valve seat B and two ends of the switch 22 extend out of the valve seat B. The direction of the two ends of the switch 22 is perpendicular to the rotating axis of the air inlet valve 21. A driving portion 221 is formed in the middle section of the switch 22 for engaging with the passive portion 213 of the air inlet valve 21. In the embodiment, the driving portion 221 is a protruding pole. The driving portion 221 of the switch 22 engages with the passive portion 213 of the air inlet valve 21 to drive the passive portion 213, so that the switch 22 can drive the air inlet valve 21 to rotate, as shown in FIG. 6 and FIG. 7.

Figure 9:
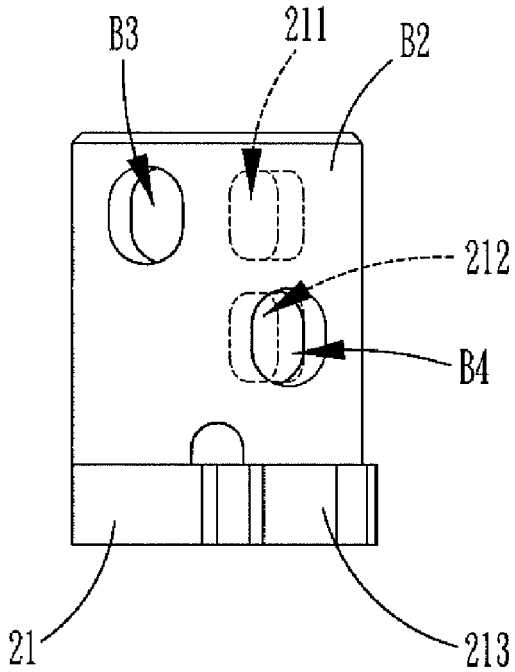
FIG. 9 is a perspective view of showing that the clockwise air inlet hole of the air inlet valve is aligned and connected with the clockwise rotation air hole of the valve sleeve in accordance with the embodiment.
Figure 10:
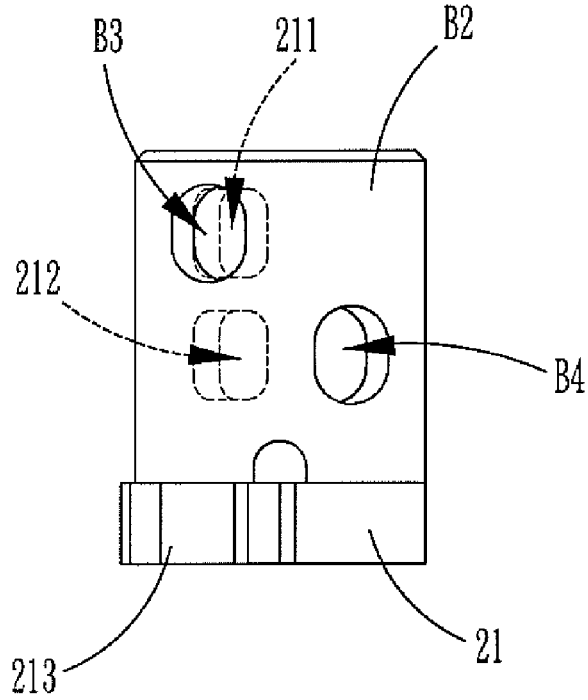
FIG. 10 is a perspective view of showing that the counterclockwise air inlet hole of the air inlet valve is aligned and connected with the counterclockwise rotation air hole of the valve sleeve in accordance with the embodiment.

The operation of switching the rotating direction is shown in FIG. 9 and FIG. 10. Pushing the switch 22 to move in a direction perpendicular to the rotating axis of the air inlet valve 21, consequently, the driving portion 221 drives the passive portion 213 of the air inlet valve 21, so that the air inlet valve 21 is driven to rotate. When the air inlet valve 21 rotates to a position at which the clockwise air inlet hole 211 is aligned and connected with the clockwise rotation air hole B3 of the valve sleeve B2, air can be guided in the clockwise rotation air inlet passage D to make the pneumatic tool A rotate clockwise. If the air inlet valve 21 rotates to a position at which the counterclockwise air inlet hole 212 is aligned and connected with the counterclockwise rotation air hole B4, air can be guided in the counterclockwise rotation air inlet passage E to make the pneumatic tool A rotate counterclockwise. By such arrangements, the rotating direction of the pneumatic tool A can be easily switched between the clockwise rotating mode and the counterclockwise rotating mode.

Figure 11:
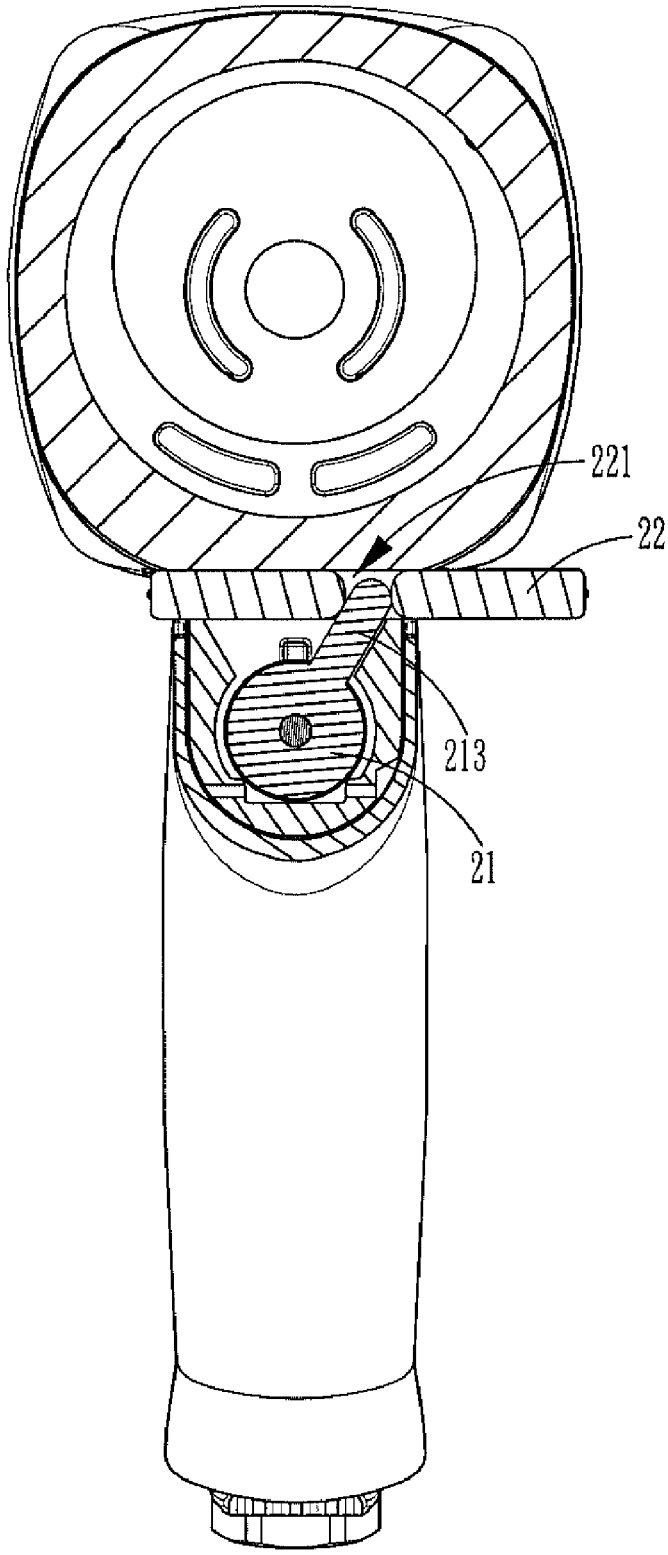
FIG. 11 is a perspective view of showing that a protruding pole structured passive portion engages with a concave structured driving portion in accordance with another embodiment.
Figure 12:
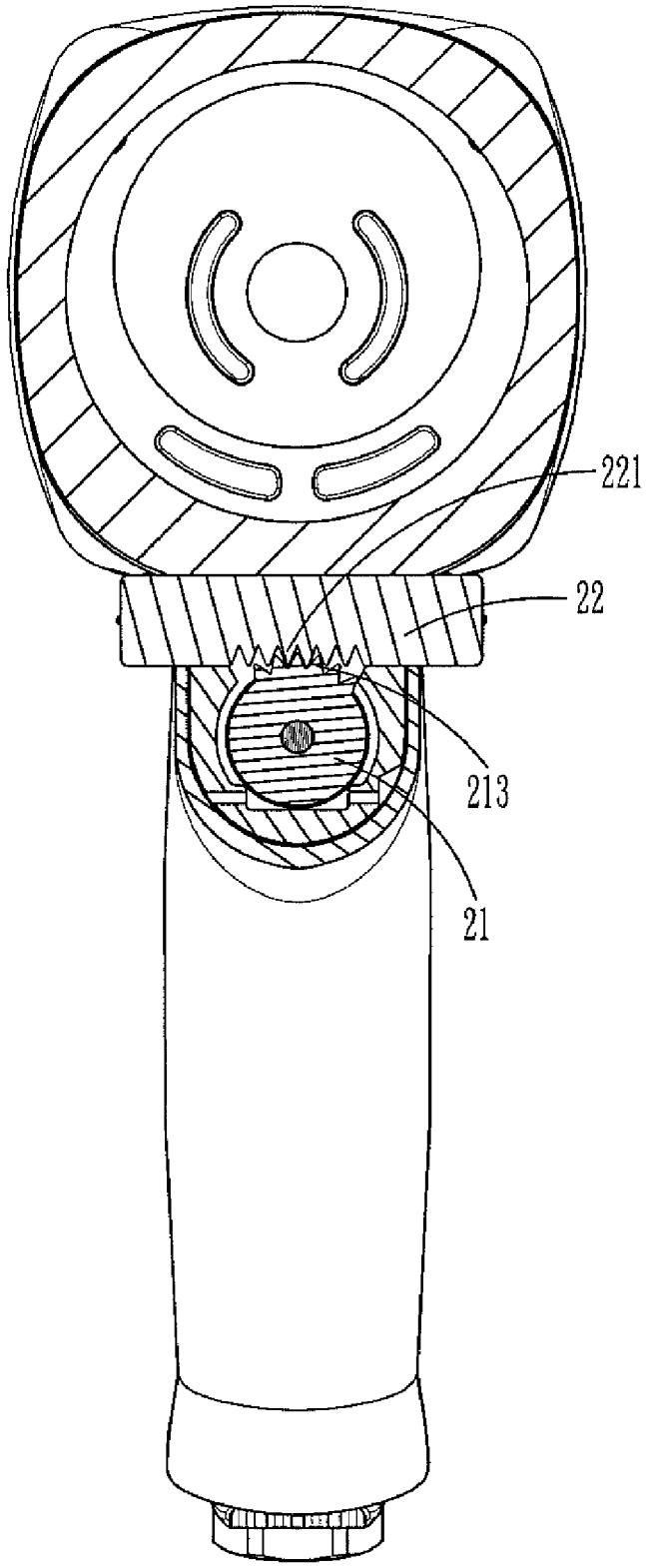
FIG. 12 is perspective view of showing that a toothed passive portion engages with a toothed driving portion in accordance with another embodiment.
Figure 13:
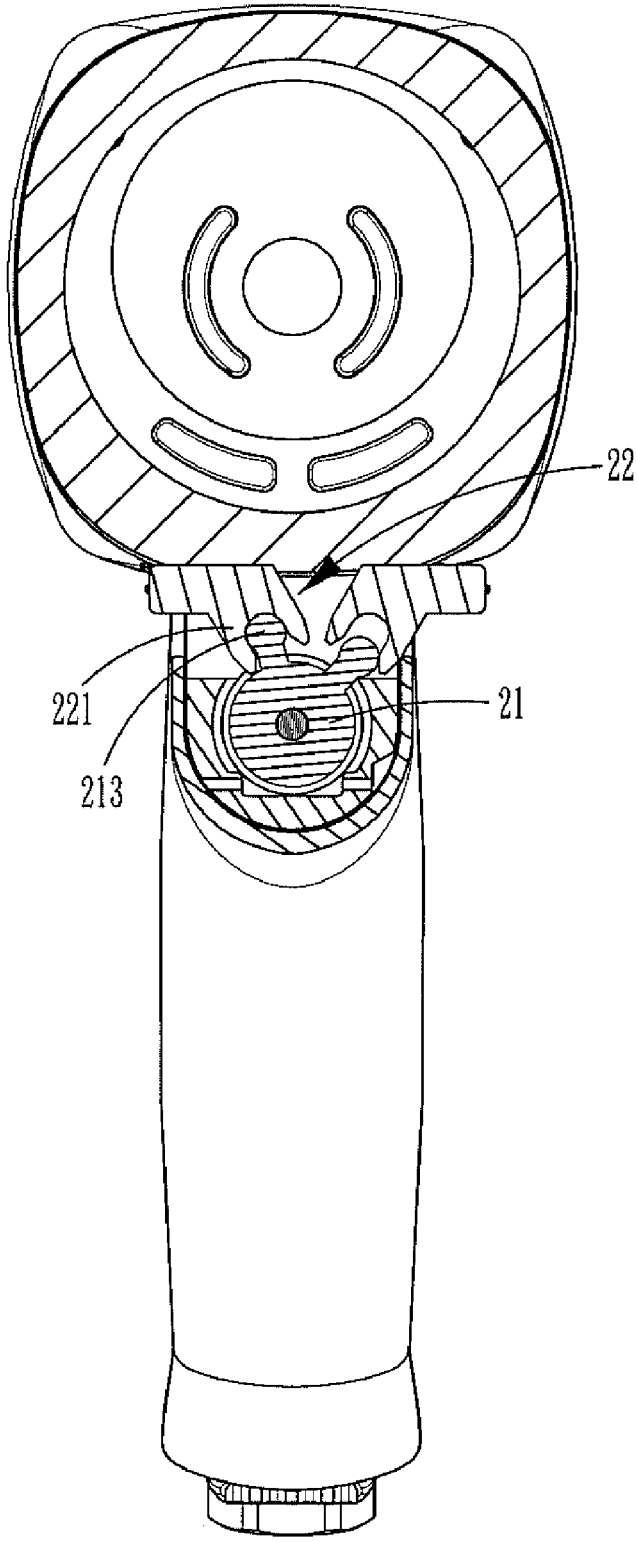
FIG. 13 is perspective view of showing that two protruding pole structured passive portions engages with two concave structured driving portions in accordance with another embodiment.

Other embodiments of the passive portion 213 of the air inlet valve 21 and the driving portion 221 of the switch 22 are shown in FIGS. 11-12, which are described in detail below. The passive portion 213 is a protruding pole, and the driving portion 221 is a concave structure for engaging with the passive portion 213. Besides, the passive portion 213 and the driving portion 221 can be toothed structures for engaging with each other In addition, as shown in FIG. 13, the air inlet valve 21 is provided with two passive portions 213 in the form of protruding poles, and the switch 22 is made up of two subassemblies (not shown), which extend out of two sides of the pneumatic tool A, respectively. Each of the subassemblies is provided with a driving portion 221 that is an engaging structure for engaging with each of the passive portions 213.

As compared with a conventional rotating direction switching device for a pneumatic tool, users only need to push the switch 22 of the present invention to move in a direction perpendicular to the rotating axis of the air inlet valve 21 to switch between the clockwise rotating mode and the counterclockwise rotating mode. The driving portion 221 drives the passive portion 213 of the air inlet valve 21, so that the air inlet valve 21 is driven to rotate. Therefore, the rotating direction of the pneumatic tool A can be easily switched between the clockwise rotating mode and the counterclockwise rotating mode by pushing the switch 22 to two different sides. A switch 13 of a conventional pneumatic wrench 10 can be fixed only at a side of the pneumatic tool 10, so that it is not suitable for all the users who are used to using their dominant hands. It can be learned from the above comparison, the present invention can be easily operated no matter the users who are right hand or left hand dominated.

In addition, the rotating direction switching device is designed for users who operate the switch by the thumb and the forefinger. As compared with a conventional device that users have to use the thumb to operate the switch, the present invention is more convenient and more comfortable.

To summarize, a rotating direction switching device for a pneumatic tool comprises an air inlet valve and a switch. The air inlet valve is driven to switch the rotating direction of the pneumatic tool by controlling the switch, thus simplifying the operation of switching between the clockwise mode and counterclockwise mode, and facilitating the operation by a single hand. Especially, no matter users who are right hand or the left hand dominated could easily operate the pneumatic tool.

While we have shown and described various embodiments in accordance with the present invention, it is clear to those skilled in the art that further embodiments may be made without departing from the scope of the present invention.

What is claimed is:

1. A rotating direction switching device for a pneumatic tool, comprising:

an air inlet valve pivotally and rotatablely disposed in the pneumatic tool, and a passive portion being defined on a, side of the air inlet valve;

a switch fixed in the pneumatic tool and extending out of two side of the pneumatic tool, the switch being perpendicular to a rotating axis of the air inlet valve, a driving portion being formed on the middle of the switch for engaging with the passive portion of the air inlet valve, wherein the driving portion and the switch are made out of one piece, the switch slides perpendicular to the rotating axis of the air inlet valve, the switch utilizing the driving portion to drive a passive portion of the air inlet valve and consequently drive the air inlet valve to rotate, thus switching the rotating direction of the pneumatic tool.

2. The rotating direction switching device for a pneumatic tool as claimed in claim 1, wherein the passive portion of the air inlet valve is an engaging structure, the driving portion of the switch is a protruding pole for engaging with the passive portion.

3. The rotating direction switching device for a pneumatic tool as claimed in claim 1, wherein the passive portion of the air inlet valve and the driving portion of the switch are toothed structures for engaging with each other.

4. The rotating direction switching device for a pneumatic tool as claimed in claim 1, wherein the air inlet valve is provided with two passive portions that are in the form of protruding poles, and the switch is made up of two subassemblies, which extend out of two sides of the pneumatic tool, respectively, each of the subassemblies is provided with a driving portion that is an engaging structure for engaging with each of the passive portions.

5. The rotating direction switching device for a pneumatic tool as claimed in claim 4, wherein the two passive portions of the air inlet valve are protruding poles, the two driving portions of the switch are engaging structures respectively for engaging with the two passive portions.

6. The rotating direction switching device for a pneumatic tool as claimed in claim 1, wherein the passive portion of the air inlet valve is a protruding pole, the driving portion of the switch is a concave structure for engaging with the passive portion.

* * * * *